US006256788B1

(12) United States Patent
Loewer et al.

(10) Patent No.: US 6,256,788 B1
(45) Date of Patent: Jul. 10, 2001

(54) DISPOSABLE BIB

(76) Inventors: Kathryn M. Loewer, 4219 Henry Bieber Rd., Eunice, LA (US) 70535; Sarah Ann Kothmann, 2213 Goldenrod, Forth Worth, TX (US) 76111

( * ) Notice: Subject to any disclaimer, the term of this patent is extended or adjusted under 35 U.S.C. 154(b) by 0 days.

(21) Appl. No.: 09/365,700

(22) Filed: Aug. 2, 1999

(51) Int. Cl.[7] ..... A41B 13/10
(52) U.S. Cl. ..... 2/49.2; 2/52
(58) Field of Search ..... 2/49.1, 49.2, 49.3, 2/49.4, 49.5, 50, 51, 52, 48, 247, 46

(56) References Cited

U.S. PATENT DOCUMENTS

| | | | | |
|---|---|---|---|---|
| D. 357,568 | | 4/1995 | Schottland | D2/861 |
| D. 361,878 | | 9/1995 | Chadwell | D2/861 |
| D. 364,032 | | 11/1995 | Caley | D2/861 |
| D. 366,556 | | 1/1996 | Wilson | D2/861 |
| 3,257,677 | | 6/1966 | Batchelder et al. | 12/142 |
| 3,416,157 | | 12/1968 | Marder et al. | 2/49 |
| 3,916,477 | | 11/1975 | Thompson | 2/46 |
| 3,979,776 | | 9/1976 | Gruenwald | 2/49 |
| 3,995,321 | | 12/1976 | Johnson | 2/49 |
| 4,210,144 | | 7/1980 | Sarge, III et al. | 128/287 |
| 4,288,877 | * | 9/1981 | Klepfer | 2/48 |
| 4,330,888 | * | 5/1982 | Klepfer | 2/48 |
| 4,423,523 | * | 1/1984 | Bodner et al. | 2/49.4 |
| 4,495,658 | | 1/1985 | Moret et al. | 2/49 |
| 4,523,333 | | 6/1985 | Spangler | 2/49 |
| 4,620,323 | | 11/1986 | Tepper | 2/48 |
| 4,622,698 | * | 11/1986 | Heyman et al. | 2/48 |
| 5,414,903 | | 5/1995 | Porteous | 24/9 |
| 5,432,952 | | 7/1995 | Tate | 2/49.4 |
| 5,459,877 | | 10/1995 | Roberti | 2/104 |
| 5,476,697 | * | 12/1995 | Bellander | 2/49.4 |
| 5,490,289 | | 2/1996 | Lehrer | 2/49.2 |
| 5,491,844 | | 2/1996 | Kehl et al. | 2/49.1 |
| 5,570,474 | | 11/1996 | Berry et al. | 2/104 |
| 5,669,770 | * | 9/1997 | Fisher et al. | 2/49.1 |
| 5,864,878 | * | 2/1999 | Mashrick | 2/46 |
| 5,881,382 | * | 3/1999 | Bernard et al. | 2/49.1 |
| 6,000,056 | * | 12/1999 | Brady et al. | 2/49.2 |
| 6,079,048 | * | 6/2000 | Campbell | 2/49.1 |

FOREIGN PATENT DOCUMENTS

| | | | | |
|---|---|---|---|---|
| 2616046 | * | 12/1988 | (FR) | 2/49.4 |
| 1095397 | * | 12/1967 | (GB) | 2/49.1 |
| 2212710 | * | 8/1989 | (GB) | 2/49.4 |
| 87/06105 | * | 10/1987 | (WO) | 2/49.4 |

* cited by examiner

*Primary Examiner*—Amy B. Vanatta
(74) *Attorney, Agent, or Firm*—Stephen S. Mosher

(57) ABSTRACT

A disposable bib of absorbent sheet material is disclosed having a neck cut-out in the upper end and a pressure sensitive adhesive disposed over substantially the entire back surface of the bib except for an un-coated border surrounding the neck cut-out. the bib is securable to the wearer at both upper and lower ends and left and right sides. A peel-off backing may be used to preserve the adhesive until use. The adhesive may be releasable from the wearer without leaving a residue. The bib in other embodiments may include a pouch or a moisture barrier.

27 Claims, 3 Drawing Sheets

DISPOSABLE BIB

BACKGROUND OF THE INVENTION

Disposable bibs are well known in the art. Many such bibs, intended to be used once and discarded, are adapted to use by infants during feeding, by patients of dentists or other health practitioners, by patrons of beauty salons or diners in a restaurant, persons handling messy or staining materials and the like. A variety of means are employed to secure the bib to the wearer including tie cords, hook and loop fasteners, buttons, leads with clips on each end and, in some examples, adhesive-backed straps or tabs.

For example, the bib disclosed in U.S. Pat. No. 3,416,157, issued to Marder, et al., secures the neck opening of the bib around the wearer's neck but does not secure the rest of the bib to the wearer's person so that it can resist pulling on the bib material and exposing the clothing intended to be protected, particularly near the shoulders. Gruenwald, U.S. Pat. No. 3,979,776, discloses a bib which uses adhesive straps to secure the bib to the wearer's shoulders. It also permits exposure of the protected area, particularly around the neck if the wearer moves or pulls at the bib. In general, bibs secured only from the top leave the rest of the bib unsecured and thus, most of the functional portion of the bib is readily pulled to one side or the other by the wearer's movements. Johnson, in U.S. Pat. No. 3,995,321, discloses a disposable bib having a food catching pocket which is held open by adhesive tabs secured to a supporting surface such as a table and an adhesive tab to secure the bib's neck closure. While the lower end of the bib may be held in place by attachment to the table, the adhesive tabs do not permit the bib to be secured to the wearer's person so that the bib remains in place when the wearer moves or shifts position. Kehl, in U.S. Pat. No. 5,491,844, discloses a disposable bib for use by dental patients having a strip of pressure sensitive adhesive across the top edge of the back of the bib but lacks means to secure the rest of the bib to the wearer.

There is thus a need for a disposable bib adapted to the numerous uses noted above that has the ability to fully protect the wearer despite pulling at the bib or movement of the wearer. In particular, both a good seal of the bib, near the neck, and secure attachment to the wearer at the lower portion of the bib is needed to maintain the bib in position, to keep it disposed against the wearer substantially over its entire surface and to fully utilize the protective properties of the bib surface such as its absorbency, liquid repellence and the like. Moreover, an improved disposable bib must be easy to use.

SUMMARY OF THE INVENTION

The foregoing problems are solved and an advance in the art is realized by the present invention wherein a disposable bib of absorbent sheet material having a neck cut-out employs a pressure sensitive adhesive disposed over substantially the entire back surface of the bib except for an un-coated border surrounding the neck cut-out. A peel-off backing may be used to preserve the adhesive until ready for use. The adhesive is releaseable from the wearer without leaving an adhesive residue on the wearer when the bib is removed after use. In other embodiments, the bib may also include a moisture barrier or a pouch across the lower end of the bib for catching spills or debris.

In another embodiment of the present invention, the pressure sensitive adhesive is applied in strips running from top to bottom near the sides of the back side of the bib to fully attach the bib to the wearer in applications, for example, where a close seal entirely around the neck cut-out is not important or as a means of reducing manufacturing cost. In other embodiments, the pouch may be formed by folding an extension of the lower end of the bib material against the front or back surface of the bib and secured to the sides of the bib. When the pouch is formed by an extension flap folded against the back side of the bib, the top edge or lip of the pouch is formed by a slit which may be a line of perforations in the front or main panel of the bib. The top edge or lip of the pouch may then be pulled away from the bib to provide a basin for spills and debris.

BRIEF DESCRIPTION OF THE DRAWINGS

For a more complete understanding of the present invention and the advantages thereof, reference is now made to the following description taken in conjunction with the accompanying Drawings in which:

FIG. 2*c* illustrates a sectional view of the lower portion of the disposable bib shown in FIG. 2*a.

DETAILED DESCRIPTION OF THE INVENTION

Figure 1A:
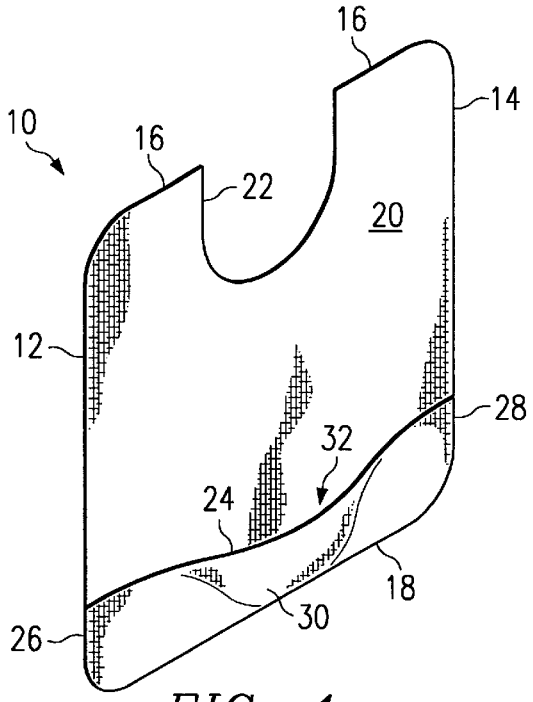
FIG. 1*a* illustrates a perspective view of the front side of a disposable bib of the present invention.

Referring to FIG. 1*a,* there is illustrated a perspective view of the front side 20 of a disposable bib 10 of the present invention. The bib 10 is constructed of absorbent sheet material having a first side 12 and a second side 14, an upper end 16 and a lower end 18, front side 20 and a back side (not shown in FIG. 1*a*.) A substantially U-shaped or substantially rounded neck-sized cutout 22 is provided in the upper end 16 approximately midway between the first side 12 and the second side 14. In an alternative embodiment illustrated in FIG. 1*e,* the neck-sized cut-out 22 may be defined by a line of perforations 15 wherein the portion to be cut-out 17 may be retained with the bib 10 and torn away from the bib 10 for use as a small accessory wipe by the wearer.

Transversely disposed across the lower end 18 of the bib 10 shown in FIG. 1*a* is a pouch 30 formed of absorbent sheet material such as that used to make the bib 10 or it may be formed of non-absorbent sheet material having properties suitable for providing a pouch. The pouch 30 is attached to the bib 10 along lower end 18 and at first lower side 26 and second lower side 28 of the bib 10. The pouch 30 in one embodiment may be conveniently formed of an extension of the lower end 18 of the disposable bib 10 which is folded upward from the lower end 18 and against the front side 20 of the bib and secured at its ends to the first lower side 26 and second lower side 28 of the bib 10. The upper edge or lip 24 of the pouch 30 may be pulled away from the front side 20 of the bib 10 to form a basin 32 for catching spills and debris deposited on the front side 20 of the bib 10. The basin 32 may also provides a temporary storage place for the accessory wipe mentioned hereinabove.

The absorbent sheet material used to construct the bib 10 may comprise a single layer, e.g., such as used in household paper towels, or it may be constructed of two or more layers to provide combined properties of individual layers into a higher performance material. For example, a thin film of material (not shown) impervious to liquids may be disposed against and immediately behind the absorbent sheet layer over substantially the back side of the absorbent layer to form a compound absorbent sheet for use in the disposable bib 10 of the present invention. This liquid-impervious layer thus may act to prevent penetration of moisture or liquid stains to the person or clothing of the wearer while the absorbent layer catches and retains the spilled debris falling on the front side of the bib 10. Alternatively, the absorbent material used in constructing thin disposable diapers would also be suitable for the disposable bib 10 in some applications where high absorption of liquids is needed.

Figure 1B:
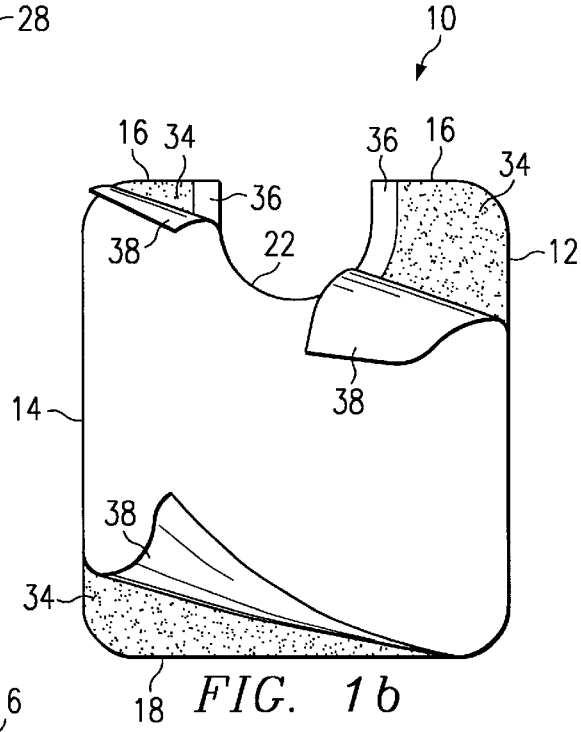
FIG. 1*b* illustrates a back side view of the disposable bib shown in FIG. 1*a;*

Referring now to FIG. 1*b,* there is illustrated a back side view of a preferred embodiment of the disposable bib 10 of the present invention as shown in FIG. 1*a*. The disposable bib 10 is shown having a first side 12 and a second side 14, an upper end 16 and a lower end 18, and the neck-sized cut-out 22 in the upper end 16. Further in FIG. 1*b* is illustrated a pressure sensitive adhesive coating 34 covering substantially all of the back side surface of the disposable bib 10 except for the region 36 of the back side proximately surrounding the neck-sized cut-out 22. The purpose of this un-coated region 36 is to provide improved comfort for the wearer wherein the un-coated region 36 is more likely to rest comfortably against the wearer's bare skin around the neck than an adhesive-coated portion of the bib. With the pressure sensitive adhesive coating 34 applied near the neck-sized cut-out, for example leaving un-coated region 36 at least ¼ inch wide, the bib 10 is securable to the wearer over substantially all its area. The pressure sensitive adhesive 34 used to coat the back side of the bib 10 should be formulated to have a low tack characteristic so that it is readily releasable from the wearer's person following use of the bib 10 without leaving adhesive residue yet has sufficient adhesiveness to secure the lightweight disposable bib 10 during use.

Continuing with FIG. 1*b,* a peel-off backing 38 is shown in a partially peeled away position to expose the pressure sensitive adhesive coating 34. The peel-off backing 38 may cover the entire back side of the bib 10 or only the region covered by the adhesive coating 34. The peel-off backing 38, which preserves the adhesive coating 34 until the bib 10 is prepared for use, is advantageously also made of disposable material.

Figure 1C:
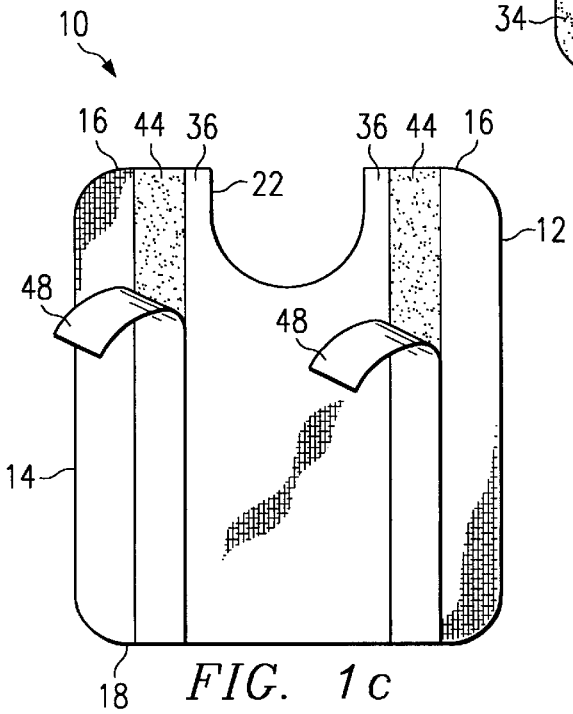
FIG. 1*c* illustrates a back side view of an alternative embodiment of the disposable bib shown in FIG. 1*a;*

Referring now to FIG. 1*c,* there is illustrated a back side view of an alternative embodiment of the disposable bib 10 of the present invention shown in FIG. 1*a*. The disposable bib 10 is shown having a first side 12 and a second side 14, an upper end 16 and a lower end 18, and the neck-sized cut-out 22 in the upper end 16. Further in FIG. 1*c* is illustrated the coating of a pressure sensitive adhesive in two longitudinal strips 44 and 44' disposed on each first side 12 and second side 14 of the back side of the bib 10 and extending from the upper end 16 to the lower end 18. Each longitudinal strip 44 and 44' is spaced between the neck-sized cut-out 22 and the proximate first side 12 or second side 14 respectively. As in the embodiment shown in FIG. 1*b* a region 36 surrounding either side of the neck-sized cut-out 22 by a width of at least ¼ inch is left un-coated to provide improved comfort for the wearer. The pressure sensitive adhesive strips 44 and 44' are preserved until use by peel-off backing strips 48 and 48'. The disposition of the pressure sensitive adhesive coating in this manner conforms to the principles of the present invention by securing both first side 12 and second side 14 and both upper end 16 and lower end 18 to the wearer yet uses substantially less adhesive and is therefore manufacturable at a lower cost.

Figure 1D:
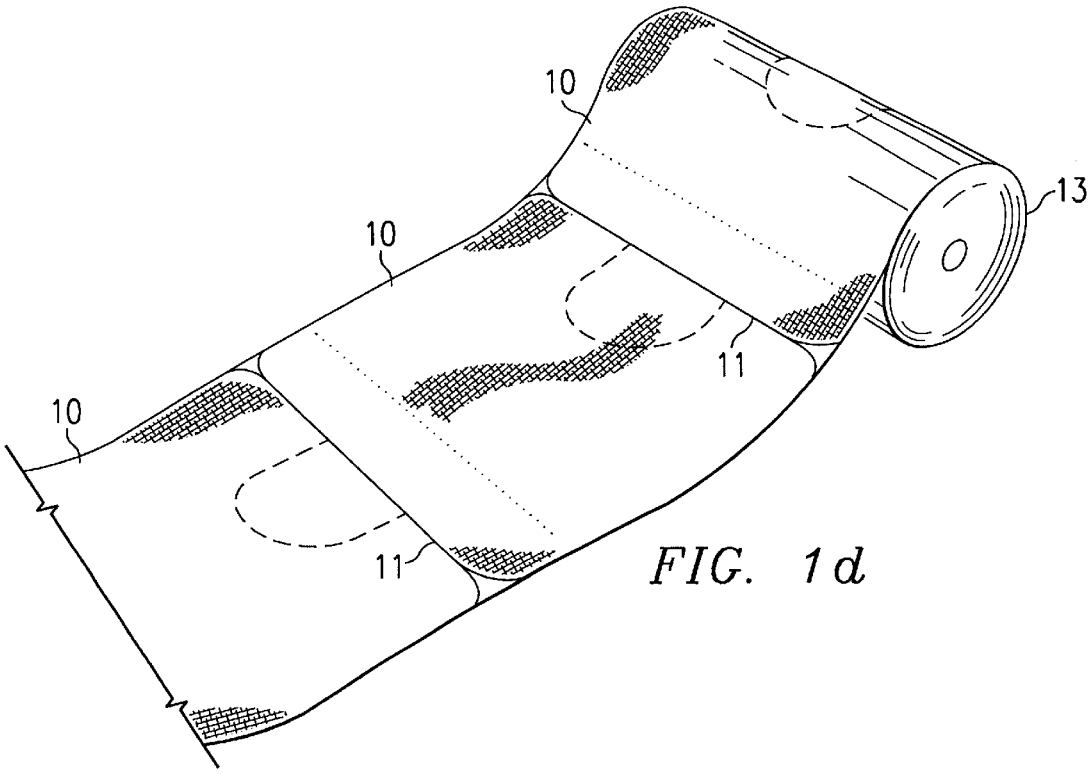
FIG. 1*d* illustrates a perspective view of a roll of disposable bibs.
Figure 1E:
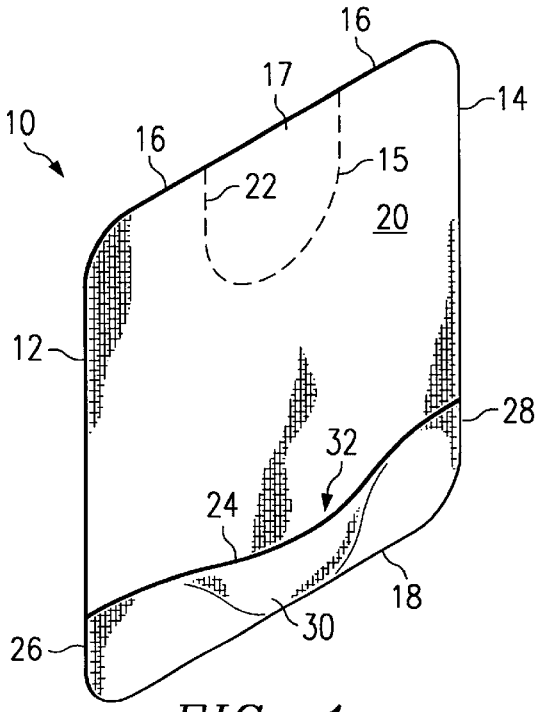
FIG. 1*e* illustrates a front perspective view of an alternative embodiment of the disposable bib of FIG. 1*a.*

Referring now to FIG. 1*d,* a plurality of bibs 10 may be detachably connected end-to end and separable along a line of detachment 11 therebetween in a continuous ribbon wound on a roll 13 until use.

Figure 2A:
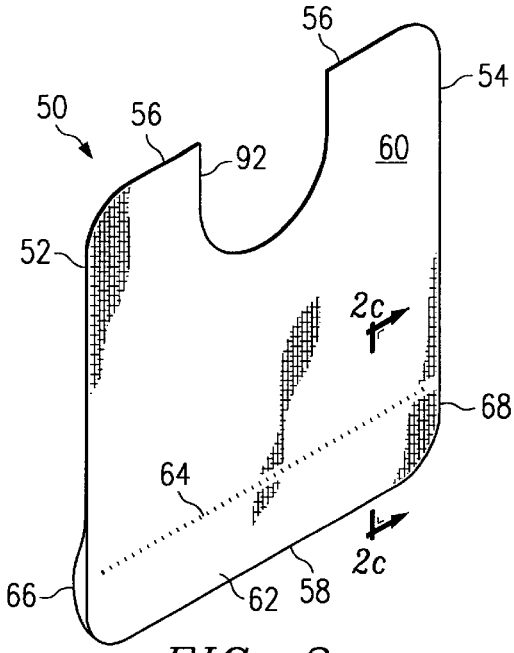
FIG. 2*a* illustrates a front perspective view of an alternative embodiment of the disposable bib of FIG. 1*a;*

Referring now to FIG. 2*a,* there is illustrated a front perspective of another alternate embodiment of the disposable bib of FIG. 1*a*. The disposable bib 50 is constructed of absorbent sheet material having a first side 52 and a second side 54, an upper end 56 and a lower end 58, a front side 60 and a back side (not shown in FIG. 2*a*). A substantially U-shaped or substantially rounded neck-sized cut-out 92 is provided in the upper end 56 approximately midway between the first side 52 and the second side 54. In an alternative embodiment, the neck-sized cut-out 92 may be defined by a line of perforations (not shown) wherein the portion to be cut out (also not shown) may be retained with the bib 50 and torn away from the bib 50 for use as a small accessory wipe by the wearer similar to FIG. 1*e*.

Transversely disposed across the lower end 58 of the bib 50 shown in FIG. 2*a* is a transverse slit 64, which may advantageously be a line of perforations extending nearly the full width of the bib 50, between the first side 52 and the second side 54, but short enough to leave an unslit margin with both first side 52 and second side 54. The transverse slit 64 is provided as the lip of a pouch 62 to be described hereinbelow. It will also be noted that FIG. 2*a* identifies a first end 66 and a second end 68 of the pouch 62. Also shown is a sectional line 2*c*–2*c*' to identify the view illustrated in FIG. 2*c* to be described hereinbelow.

Figure 2B:
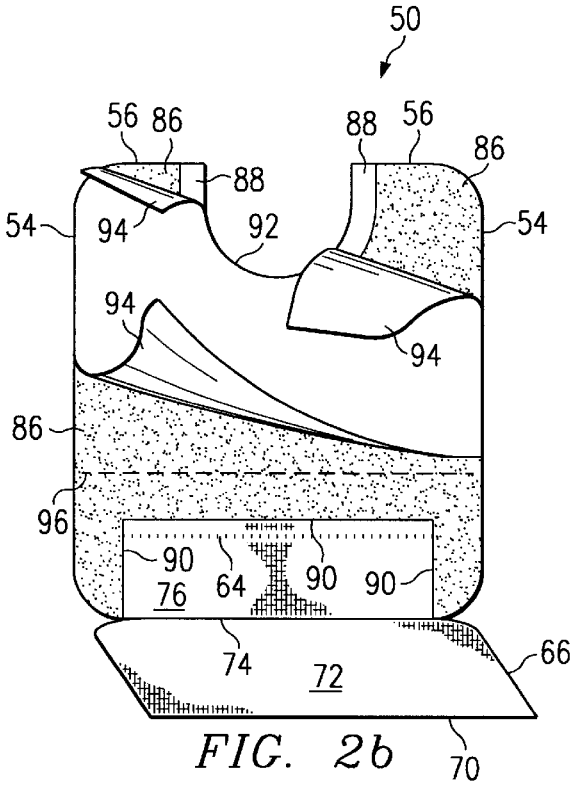
FIG. 2*b* illustrates a back side view of the disposable bib shown in FIG. 2*a;*

Referring now to FIG. 2*b,* there is illustrated a back side view of the disposable bib 50 shown in FIG. 2*a*. The disposable bib 50 is shown having a first side 52 and a second side 54, an upper end 56 and the neck-sized cut-out 92 in the upper end 56, and the transverse slit 64 as viewed from the back side of the bib 50. Further in FIG. 2*b* is illustrated a pressure sensitive adhesive coating 86 covering substantially all of the back side of the disposable bib 50 except for the region 88 of the back side proximately surrounding the neck-sized cut-out 92 (in the same manner and for the same purpose as for the bib 10 of FIG. 1) and except for the region 76 bounded by border 90 and line 74. A peel-off backing 94, which until peeled away from the bib 50 covers the adhesive-coated region above dashed line 96, is shown in a partially peeled-away position to expose the pressure sensitive adhesive coating 86.

Further in FIG. 2*b* is shown an extension 72 of the lower end (58 in FIG. 2*a*) of the bib 50 having a transverse edge 70. The adhesive coating 86 adjacent to the border 90, below the dashed line 96 in FIG. 2*b,* is left exposed to secure the edges of extension 72 to be used to form pouch 62 as will be described. It will be appreciated from inspection of FIG. 2*b* that the portion of the adhesive coating 86 adjacent to the border 90 below dashed line 96 is shaped like an inverted U and replicates the outline of the extension 72 of the lower end 58 (See FIG. 2*a*) of bib 50. Thus, when the extension 72 is folded during manufacture toward the back side 82 of bib 50 along line 74 and the border (first side 66, second side 68 and transverse edge 70) of extension 72 is pressed against the adhesive coating 86 therealong, an enclosed space, between the bib 50 and extension 72, accessible through transverse slit 64, is formed to provide pouch 62 when the transverse slit 64 is opened. Transverse slit 64 is positioned just below the portion of the adhesive coating 86 that secures the transverse edge of extension 72 to bib 50 so that when opened to form a pouch 62, the depth of the pouch 62 is maximized.

Figure 2C:
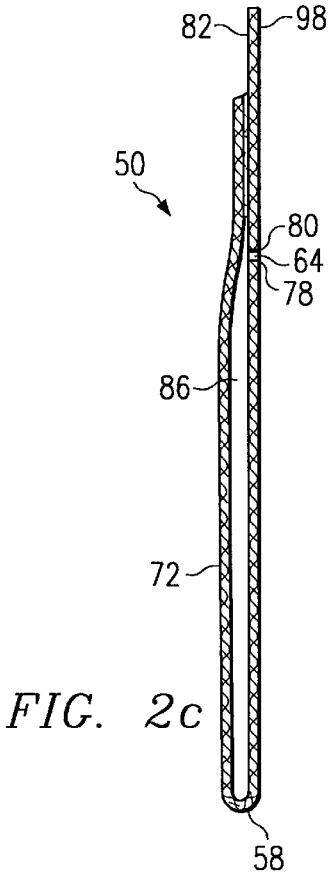
Figure 2D:
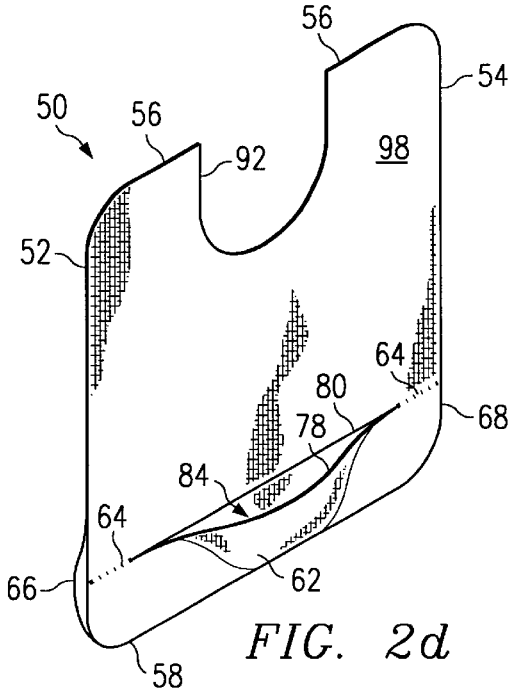
* and FIG. 2*d* illustrates a perspective view of the disposable bib of FIG. 2*a* showing the pouch in an open position.

Referring now to FIG. 2*c,* there is illustrated a sectional view (line 2*c*–2*c* in FIG. 2*a*) of the lower end of disposable bib 50 showing the extension 72 folded against the back side 82 of bib 50 and secured by the adhesive coating 86 to form the space (not shown) between extension 72 and the back side 82 of bib 50 that may be used to provide a pouch accessible through transverse slit 64 as will be described. Reference numeral 98 indicates the front side of bib 50 in FIG. 2*c.* Transverse slit 64 when opened as shown in FIG. 2*d,* a front perspective view of disposable bib 50, forms an upper lip 80 in the front side 98 of bib 50 and a lower lip 78 which is pulled away from the bib 50 to create the basin 84 of the pouch 62. The basin 84 of pouch 62 is thereby formed to catch spills and debris falling on the front side 98 of bib 50.

The embodiments of the present invention shown in the FIGURES herein and the accompanying descriptions are intended to be illustrative of the principle features of the present inventions and not limitations thereof Thus, although the preferred embodiment has been described in detail, it should be understood that various changes, substitutions and alterations can be made therein without departing from the spirit and scope of the invention as defined by the appended claims.

What is claimed is:

1. A disposable bib for human use, comprising:

an absorbent sheet having first and second sides, upper and lower ends and front and back sides;

a neck-sized cut-out in said upper end of said sheet, positioned approximately midway between said first and second sides and extending toward said lower end;

a pressure sensitive adhesive coating on the back side of said bib wherein the back side of said bib proximately surrounding the border of said cut-out is un-coated by said pressure sensitive adhesive; and a pouch disposed in a closed configuration substantially across the lower end of the front side of said bib, said pouch having an upper edge which may be pulled away from the front side of said bib to form a basin to catch spills and debris, wherein said pouch comprises an upwardly folded extension of the lower end of said absorbent sheet and wherein the ends of said upwardly folded extension, said extension folded against said bib front side, are secured to the proximate edges of the first and second sides of said bib.

2. The bib of claim 1, comprising a peel-off backing covering said pressure sensitive adhesive coating until ready for use.

3. The bib of claim 1, wherein the un-coated portion of the backside of the bib includes an area within at least one-quarter inch of said cut-out.

4. The bib of claim 2, wherein said pressure sensitive adhesive, upon removal of said backing, permits adhering said bib to a wearer's person and removing said bib wherein no adhesive remains on said wearer's person.

5. The bib of claim 1, comprising a moisture barrier layer disposed between said absorbent sheet and said pressure sensitive adhesive.

6. The bib of claim 1, comprising a pressure sensitive adhesive having a low tack characteristic to releaseably adhere to said wearer's person.

7. The bib of claim 1, wherein said pressure sensitive adhesive coating is disposed in at least two longitudinal strips extending between said upper and lower ends of the bib and spaced laterally between the neck-sized cut-out and a corresponding first or second side of the bib.

8. The bib of claim 1, wherein a plurality of said bibs are detachably connected end-to-end and separable along a line of detachment therebetween, in a continuous ribbon wound in a roll until use.

9. The bib of claim 8, wherein each bib is dispensed from said roll by unwinding and tearing off the bib at said line of detachment.

10. The bib of claim 1, wherein said neck-sized cut-out is defined by a line of perforations for tear-out removal of the portion that is cut out by the user prior to use.

11. The bib of claim 10, wherein the removed cut-out portion is useable as a wipe.

12. The bib of claim 1, wherein said neck-sized cut-out forms a substantially round opening.

13. The bib of claim 1, wherein said neck-sized cut-out forms a substantially U-shaped opening.

14. A disposable bib for human use, comprising:

an absorbent sheet having first and second sides, upper and lower ends and front and back sides;

a neck-sized cut-out in said upper end of said sheet, positioned approximately midway between said first and second sides and extending toward said lower end:

a pressure sensitive adhesive coating on the back side of said bib wherein the back side of said bib proximately surrounding the border of said cut-out is un-coated by said pressure sensitive adhesive; and a pouch disposed in a closed configuration substantially across the lower end of the front side of said bib, said pouch having an upper edge which may be pulled away from the front side of said bib to form a basin to catch spills and debris, wherein said pouch comprises an upwardly folded extension of the lower end of said absorbent sheet and wherein the ends of said upwardly folded extension, said extension folded against said bib back side, are secured to the proximate edges of the first and second sides of said bib, wherein further the uppermost edge of said extension is secured to said bib back-side and wherein the lower edge of a traverse slit in said bib front side, said transverse slit positioned just below the location where said upper most edge of said extension is secured to said bib back side, may be pulled away from the front side of said bib to form said basin.

15. The bib of claim 14, wherein said transverse slit is a line of perforation to permit separation of the bib material therealong.

16. The bib of claim 14, comprising a peel-off backing covering said pressure sensitive adhesive coating until ready for use.

17. The bib of claim 14, wherein the un-coated portion of the backside of the bib includes an area within at least one-quarter inch of said cut-out.

18. The bib of claim 14, wherein said pressure sensitive adhesive, upon removal of said backing, permits adhering said bib to a wearer's person and removing said bib wherein no adhesive remains on said wearer's person.

19. The bib of claim 14, wherein a moisture barrier layer disposed between said absorbent sheet and said pressure sensitive adhesive.

20. The bib of claim 14, wherein a pressure sensitive adhesive having a low tack characteristic to releaseably adhere to said wearer's person.

21. The bib of claim 14, wherein said pressure sensitive adhesive coating is disposed in at least two longitudinal strips extending between said upper and lower ends of the bib and spaced laterally between the neck-sized cut-out and a corresponding first or second side of the bib.

22. The bib of claim 14, wherein a plurality of said bibs are detachably connected end-to-end and separable along a line of detachment therebetween, in a continuous ribbon wound in a roll until use.

23. The bib of claim 22, wherein each bib is dispensed from said roll by unwinding and tearing off the bib at said line of detachment.

24. The bib of claim 14, wherein said neck-sized cut-out is defined by a line of perforations for tear-out removal of the portion that is cut out by the user prior to use.

25. The bib of claim 24, wherein the removed cut-out portion is useable as a wipe.

26. The bib of claim 14, wherein said neck-sized cut-out forms a substantially round opening.

27. The bib of claim 14, wherein said neck-sized cut-out forms a substantially U-shaped opening.

* * * * *